United States Patent [19]

Gyimothy

[11] Patent Number: 4,854,478

[45] Date of Patent: Aug. 8, 1989

[54] TABLET DISPENSER

[75] Inventor: Gabor Gyimothy, Kilchberg, Switzerland

[73] Assignee: Alfatechnic AG, Switzerland

[21] Appl. No.: 170,174

[22] Filed: Mar. 18, 1988

[30] Foreign Application Priority Data

Mar. 20, 1987 [CH] Switzerland ..... 01081/87

[51] Int. Cl.[4] ..... B65D 83/04

[52] U.S. Cl. ..... 221/190; 221/202; 221/252; 221/263

[58] Field of Search ..... 221/190, 202, 263, 264, 221/252; 206/540

[56] References Cited

U.S. PATENT DOCUMENTS 4,228,920 10/1980 Burton ..... 221/265
4,354,619 10/1982 Wippermann et al. ..... 221/263
4,653,668 3/1987 Gibilisco et al. ..... 221/263 X
4,767,023 8/1988 Hackmann et al. ..... 221/190 X

FOREIGN PATENT DOCUMENTS 0188278 7/1986 European Pat. Off. ..... 221/190
2045977 3/1972 Fed. Rep. of Germany .
2638164 3/1978 Fed. Rep. of Germany .
2108086 5/1983 United Kingdom .

*Primary Examiner*—F. J. Bartuska
*Attorney, Agent, or Firm*—Thomas W. Speckman

[57] ABSTRACT

An overall cylindrically shaped tablet dispenser that operates by exerting an external vertical force which compresses, through a sliding action, an upper portion toward a lower portion thereby causing a mechanism to issue a tablet. This tablet dispenser can be operated by placing the bottom of the dispenser against a ground surface and pushing downward on the top of the dispenser. Thus, this tablet dispenser is particularly advantageous to motor-impaired patients.

16 Claims, 4 Drawing Sheets

TABLET DISPENSER

BACKGROUND OF THE INVENTION

1. Field of the Invention

The present invention concerns a tablet dispenser with a tablet storage space, at least one tablet separating channel, and one tablet issuing mechanism, which are all positioned in a successively descending direction from one another, so that the tablets to be dispensed move, under the influence of gravity, from the starting point in the tablet storage space to the tablet issuing mechanism.

2. Description of the Prior Art

Although the developmental forms of tablet dispensers are extraordinarily diverse, the above-stated characteristics are discernible in a large number of tablet dispensers. The tablets to be dispensed, which are present in large quantities, are located in a storage space which has a suitable base surface, on which the tablets reach a tablet orientation space. This tablet orientation space can be positioned centrally as shown in GB-A No. 2 108 086, U.S. Pat. No. 4,354,619 and DE-A No. 20 45 977, or peripherally to the tablet A storage space as shown in DE-A No. 26 38 164 and U.S. Pat. No. 4,228,920. The form of the tablet orientation space must be adjusted to the shape of the dispensed tablets and obtaining matching forms becomes more complex as the external contour of the tablet becomes more irregular. Current tablet dispensers only operate with the simplest geometrical forms, such as spherical, cubical or disk-shaped tablets.

The more complex the form and the greater the volume of the tablet, the more difficult it is to create a reliably operating tablet dispenser. A major problem exists in that there are no assurances for reliable continuous feeding, orienting, and separating. The problem exists because feeding, orienting, and separating relatively large tablets with various forms is unlikely with the use of gravity alone. In gravity feed systems, the tablets tend to tilt and block each other in both the orienting channel and the tablet separation channel.

Many solutions with active conveying or displacement measures for the actual issuing mechanism have been attempted; however, serious difficulties have arisen in this area.

SUMMARY OF THE INVENTION

It is an object of this invention to provide a tablet dispenser of the type described above which eliminates the difficulties described above. One embodiment of a tablet dispenser in accordance with this invention has a tablet storage space, at least one tablet separating channel, and one tablet issuing mechanism all of which are positioned in successively descending order. The dispenser of this invention causes the tablets to move under the influence of gravity from the tablet storage space, the starting point, to the tablet issuing mechanism.

The tablet dispenser has at least two portions, an upper portion and a lower portion. Both portions fit together in a form-locking manner which prevents rotation of one relative to another but allows vertical displacement of one relative to another along the longitudinal axis. The interior of the upper portion forms a funnel-shaped tablet supply space. The lower area of the funnel-shaped tablet supply space extends downward forming the outermost of two concentric ring-shaped walls.

The concentric ring-shaped walls are displaced with respect to each other when the two portions are moved relative to one another. The area between the concentric walls defines a tablet orienting space and a tablet separating channel. The innermost concentric wall has a top, thus forming a column. As the upper and lower portions displace with respect to each other, the column slides in and out of the tablet supply space.

The lower portion of the tablet dispenser has a plurality of elastically deformable spring-like elements. The spring-like elements are connected to a horizontal intermediate base located approximately halfway up the internal side of the concentric vertical wall of the lower portion and the spring-like elements are extended vertically upward from the intermediate base. The upward extendions of the spring-like elements abut downward extensions from or the lower bottom side of the funnel-shaped tablet supply space. The bottom of the tablet orienting space slopes downward and extends partially around the lower area of the column formed by the internal concentric wall. The tablet orienting space discharges into a vertical tablet separating channel. The vertical tablet separating channel leads to a tablet issuing mechanism.

Another embodiment of a tablet dispenser in accordance with this invention may have a plurality of tablet separating channels which run vertically along the column. Tablet separating channels are formed by walls projecting radially from the column.

The tablet issuing mechanism has a discharge plate, the lower end of the discharge plate proceeds onto at least one strut and is directed radially inward on the tubular extension of the funnel-shaped tablet supply space. In the resting position of the lower and upper portions the discharge plate extends approximately into the plane of the intermediate base. The discharge plate seals an aperture opening of the tablet separating channel. The external wall of the tablet separating channel has an upper wall portion, the lower tubular extension, and a lower wall portion, concentric vertical wall.

By applying a force to the top and/or bottom of the tablet dispenser, the upper and lower wall portions slide against one another. Vertical compression reduces the cross-sectional height of the vertical section of the tablet separating channel. As the upper wall portion slides downward and toward the center of the tablet dispenser, the upper wall prevents the discharge of an upper tablet and allows the discharge of a lower tablet.

Another embodiment of a tablet dispenser in accordance with this invention with a plurality of tablet separating channels has a disk with an upwardly directed central casing. A plurality of vertical circularly spaced partial walls support the disk. The bottoms of the partial walls connect to the intermediate base. The central casing penetrates through the intermediate base and partially encircles the column with the radial separating walls of the separating channel. A relief-type control cam is on the external wall of the central casing. At least one contact point, solidly connected with the upper portion of the tablet dispenser, contacts the control cam. The disk gradually rotates during vertical forcing motion of the upper and lower wall portions. The disk has at least one opening which aligns with the separating channels when the tablet dispenser is in its fully compressed position.

A removable cap, made of transparent material, covers the funnel-shaped tablet supply space. The tablet dispenser has a lower edge located near the bottom of the lower portion. The lower edge acts as a support surface for the tablet dispenser. The vertical displacement between the tablet dispenser in its rest position and its fully compressed position must be less than the distance from the intermediate base to the lower edge support surface.

BRIEF DESCRIPTION OF THE DRAWINGS

Three embodiments of this invention are shown in detail in the drawing, and described in the following description, wherein.

DESCRIPTION OF THE PREFERRED EMBODIMENTS

One embodiment shown in FIGS. 1 to 6 comprises only two movable parts. These parts also appear in another embodiment shown in FIGS. 7 to 15, as well as in yet another embodiment in accordance with FIG. 16. Thus, the essential elements of the tablet dispenser are described with respect to the embodiment shown in FIGS. 1 to 6. In other embodiments the elements vary slightly in only their general appearance, but otherwise perform the same function, however, such elements are only generally described in the other embodiments, while retaining the same reference numbers and nomenclature.

Figure 1:
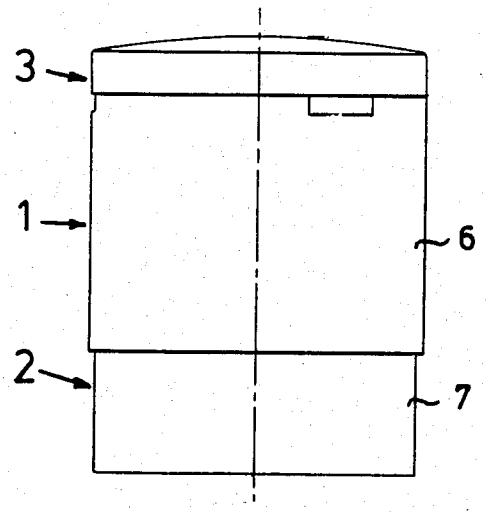
FIG. 1: is a side view of one embodiment of a two-part tablet dispenser.
Figure 2:
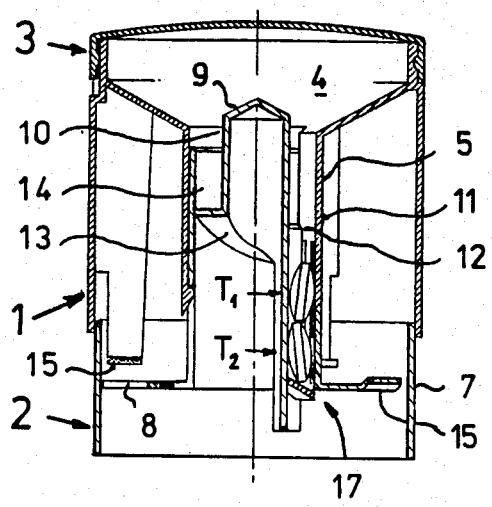
FIG. 2: is a cross-sectional side view of one embodiment of an operating position of a two-part tablet dispenser.
Figure 3:
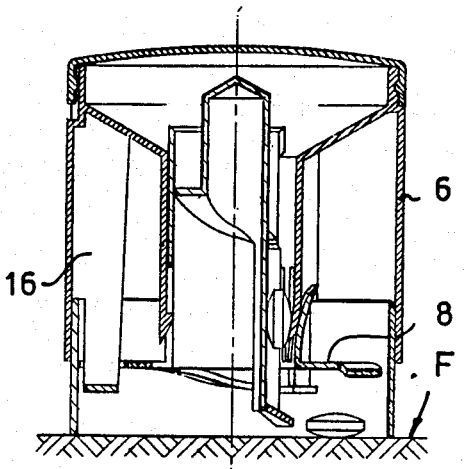
FIG. 3: is a cross-sectional side view of another operating position of a two-part tablet dispenser as shown in FIG. 2.

FIG. 1 shows a side view of the tablet discharge direction of the tablets, in the usual position of use which is shown vertically, runs from top to bottom. The upper portion (1) has an inside diameter slightly larger than the outside diameter of lower portion (2) so that both portions (1, 2) can be telescopically slid into one another along the longitudinal axial direction. A cap (3), preferably transparent, is placed over the upper portion (1). Cap (3) covers a supply space in upper portion (1), and allows observation of the quantity of tablets located therein. The tablet dispenser in accordance with FIG. 1 is shown in FIG. 2 in the same, upright resting position, in a vertical section through the center. FIG. 2 shows upper portion (1), which is at the top relative to the discharge direction of the tablets, having a funnel-shaped tablet supply space (4) which is covered by cap (3). A tubular extension (5) connects with the funnel-shaped supply space (4).

A cylindrical skirt (6), which appears in FIG. 1 as the external wall of upper portion (1), runs downwardly from the upper edge of the sloping walls of the funnel-shaped supply space.

The terms "bottom" and "top" always should be understood in relation to the tablet discharge direction. Lower portion (2) has a circular wall (7), shown in FIG. 1 as the external contour, which has an intermediate base (8) located on the internal side of wall (7) at approximately one-half of the height of lower portion (2). A column-like circular wall (9) which is closed at into the funnel-shaped supply space, and extends upwardly centrally from intermediate base (8). This column-like circular wall (9), frequently termed hereinafter the "column", forms internal wall (10), relative to the central axis, and the tubular extension (5) of upper portion (1) forms external wall (11) of a tablet separating channel (12). Column (9) is set back near the top forming a shoulder (13) which descends to separating channel (12). The space above shoulder (13) represents tablet orienting space (14) into which the tablets fall and are so directed that they fit into separating channel (12).

Intermediate base (8), of which only one ring remains around column (9) has three circular spring elements (15) which are positioned around column (9), column (9) being closed at the top. Spring elements (15) extend upwardly from the level of intermediate base (8). Supports (16) projecting inwardly from the internal side of the skirt (6) abut vertically on spring elements (15).

Figure 4:
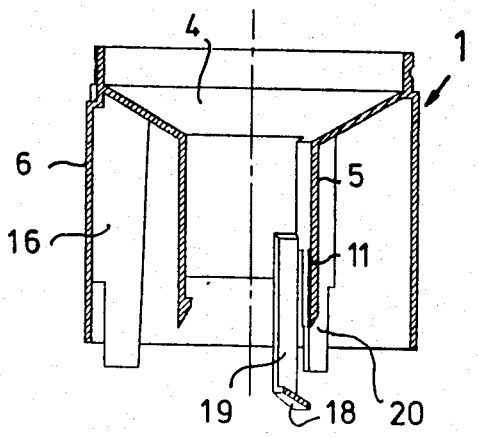
FIG. 4: is a partial cross-sectional side view of the upper portion of a tablet dispenser as shown in FIG. 2.
Figure 6:
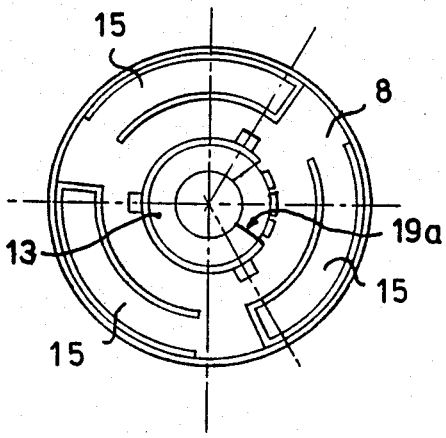
FIG. 6: is a top view of the center and lower portion of a tablet dispenser as shown in FIG. 5.

The tablet issuing mechanism (17) is, in this embodiment, integral with no additional parts; that is, the elements necessary for the issuing mechanism are integrated with both portions (1, 2) which move relative to one another. Thus, a discharge plate (18) is provided on upper portion (1) as shown in FIG. 4. Discharge plate (18) is positioned on the lower end between a strut (19) which is directed radially inward, and the vertical wall (19*a*), as shown in FIG. 6, of shoulder (13), also shown in FIG. 6, is positioned on tubular extension (5). Discharge plate (18), in the non-compressed position of upper and lower portions (1, 2), lies approximately at the level of intermediate base (8), and closes tablet separating channel (12). The upper area of external wall (11), of tablet separating channel (12), being an extension of upper portion (1), is flexibly formed by two slit apertures positioned on both edge areas of channel (12), and ends in a slope (20). In the position shown in FIG.

Figure 5:
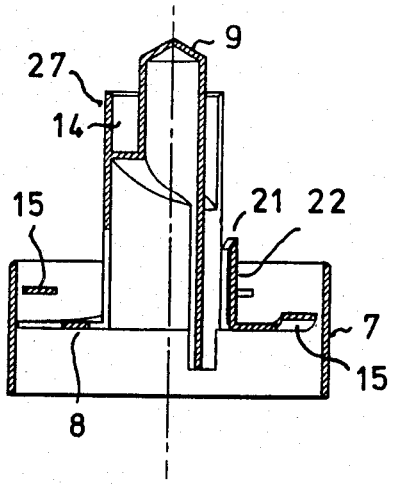
FIG. 5; is a partial cross-sectional side view of the center and lower portion of a tablet dispenser as shown in FIG. 2.

2, slope (20) faces an opposing slope (21), shown in FIG. 5, which forms the end of a likewise flexible, elastically deformable wall part (22) of lower portion (2).

In FIG. 2, both wall parts (11, 22) are aligned and expose the complete cross-sectional area of separating channel (12), so that the lowest of the tablets (T2), located in separating channel (12), rests on tablet discharge plate (18). The tablet (T1) located above tablet (T2) stands ready as the next tablet to be discharged, essentially above the separation points at slopes (20, 21). To dispense a tablet, pressure is applied to upper portion (1) or cap (3). Such pressure must overcome the spring force of spring elements (15) on supports (16). Tablet discharge plate (18) slides downwardly, causing the lowest tablet (T2) to slide from separating channel (12) and fall to the surface (F), on which the tablet dispenser is placed. Simultaneously, column (9) pushes into the tablet supply space (4), dislodges the tablets located therein and prevents any blocking of the tablets. Strut (19), which blocks the descent of shoulder (13) on the lower edge in a barrier-like manner, likewise moves downwardly and thereby frees the path for the sliding tablets. The tablets can thus move up into a possible vacant place in the tablet orienting space (14). The movement of strut (19) relative to column (9) and the slide path of shoulder (13) prevents a tablet from tilting or causes a tilted tablet to dislodge. Likewise during this compression movement, both slopes (20, 21) slide over one another, so that wall parts (11, 22) overlap, through which movement separation channel (12) narrows causing tablet (T1) to be held in the separation channel. If upper portion (1) is again released, spring elements (15) press upper portion (1) back into its starting position and the tablets slide one position further.

Figure 7:
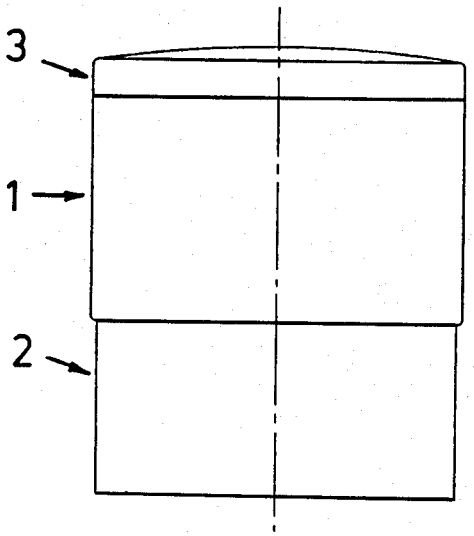
FIG. 7: is a side view of one embodiment of a three-part tablet dispenser.
Figure 8:
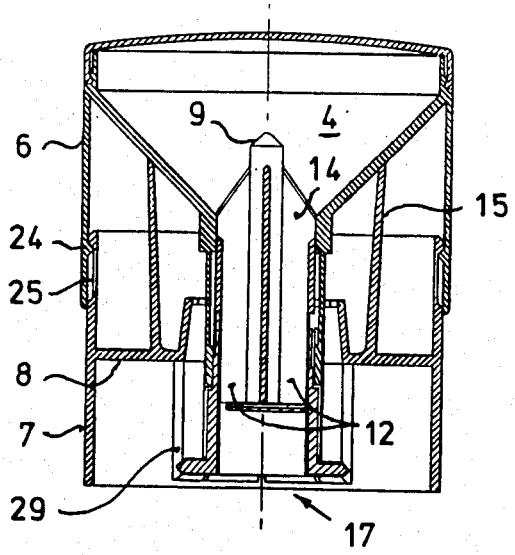
FIG. 8: is a cross-sectional side view of one embodiment of an operating position of a three-part tablet/dispenser.

Another embodiment of a tablet dispenser in accordance with this invention is shown in FIGS. 7 to 15. In FIG. 7, the tablet dispenser is again shown in a non-compressed position, which is also shown in the cross-sectional side view in FIG. 8. The elements coinciding with the previously described embodiment are provided with the same reference numbers. In addition, the discharge direction of the tablets remains the same. The part upward in relation to the discharge direction is again designated upper portion (1), the part downward designated lower portion (2), and the top part designated cap (3). The tablet supply space is somewhat larger and steeper and discharges into a relatively short tubular extension (5). Skirt (6) extending downwardly from the upper edge of the tablet supply space has, on its internal side, internally directed baffles (24) which engage in grooves (25) in the external circular wall (7) of lower portion (2). Through such arrangement, both parts are secured against rotation relative to one another, but the vertical position of upper and lower portions (1, 2) relative to one another can vary. Column (9) which is closed at the top is in turn integrally formed in lower portion (2) on intermediate base (8) of the same and has four separating walls (26) extending vertically and projecting in the axial direction. The top of column (9) also projects, in the non-compressed position, into tablet supply space (4). Separating walls (26) are conducted through tubular extension (5). A cylindrical casing (27) surrounding separating walls (26) is provided in an intermediary area. Tablet orienting space (14) is formed between separating walls (26) which taper upward toward the top of column (9) and oppositely to the funnel-shaped wall of tablet supply space (4). The connecting tablet separating channels (12) are likewise formed by the separating walls (26) and the circular wall of column (9), as well as by tubular extension (5) in the upper area and casing (27) in the central area.

Figure 9:
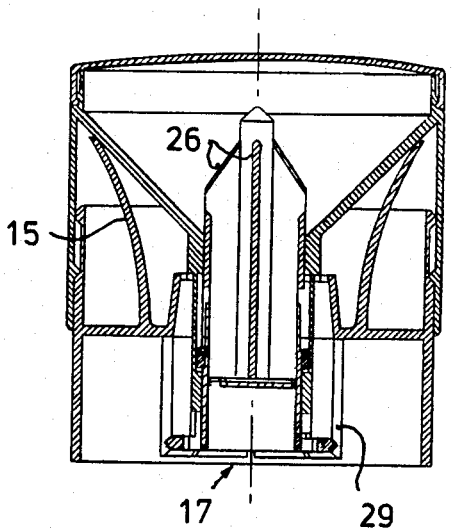
FIG. 9: is a cross-sectional side view of another operating position of a three-part tablet dispenser as shown in FIG. 8.
Figure 10:
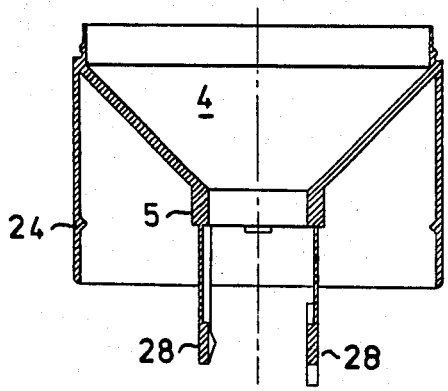
FIG. 10: is a cross-sectional side view of the upper portion of a three-part tablet dispenser as shown in FIG. 8.
Figure 11:
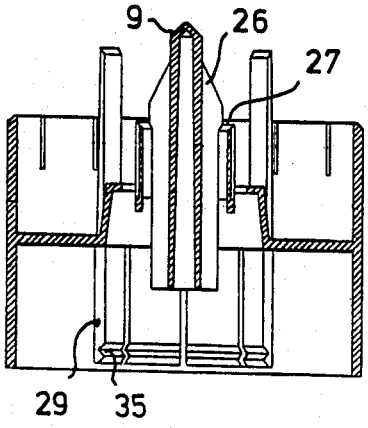
FIG. 11: is a cross-sectional side view of the lower portion of a three-part tablet dispenser as shown in FIG. 8.
Figure 12:
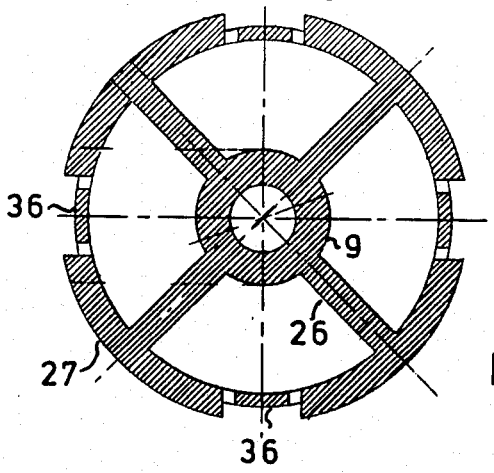
FIG. 12: is a cross-sectional top view of the tablet supply channels which discharge into the tablet issuing mechanism of a three-part tablet dispenser as shown in FIG. 8.
Figure 15:
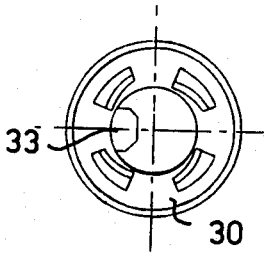
FIG. 15: is a bottom view of a tablet issuing mechanism as shown in FIG. 13.

Several finger-like spring elements (15 are attached to the intermediate base (8). In the non-compressed position, spring elements (15) extend upwardly from intermediate base (8) and are slightly inclined to the outside. The tips of spring elements (15) abut the bottom side of funnel-shaped tablet supply space (4). When sliding both movable portions (1, 2) together, the tips of spring elements (15), slide upwardly along the funnel-shaped supply space and bend elastically outwardly as shown in FIG. 9.

Figure 13:
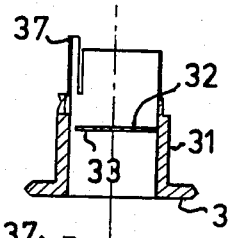
FIG. 13: is a cross-sectional side view of one embodiment of a tablet issuing mechanism of a three-part tablet dispenser as shown in FIG. 8.
Figure 14:
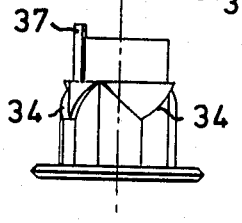
FIG. 14: is a side view of a tablet issuing mechanism as shown in FIG. 13.

Another embodiment of a tablet dispenser has a separate and movable part. The tablet dispenser as shown in FIG. 13 has a ring-shaped disk (30) and a central casing (31). Casing (31) has a horizontal covering plate (32) with a penetrating hole (33) located at an edge position, which hole has dimensions corresponding to the cross section of a tablet separating channel. A relief-type control cam (34), formed by a shoulder unit, is attached to the external side of the side of casing (31). Two contact points (28) lying radially opposed to one another are attached to tubular extension (5) of funnel-shaped tablet supply space (4) and move along relief-type control cam (34). Disk (30) is held in a form-locking manner in a V-shaped groove (35) between several partial walls (29), which are attached on the bottom of intermediate base (8) and which form a tube section. With each stroke motion of upper and lower portions (1, 2) which are displaceable with respect to one another, disk (30) is gradually turned relative to the control cam.

At the same time, further elastic tongue units (36), which are part areas of the casing (27), are alternately slid through an upper wall (37) of the rotating part to the interior of tablet separating channel (12), and, as in the previously described embodiment, block the second tablet from the bottom in the separating channel.

Figure 16:
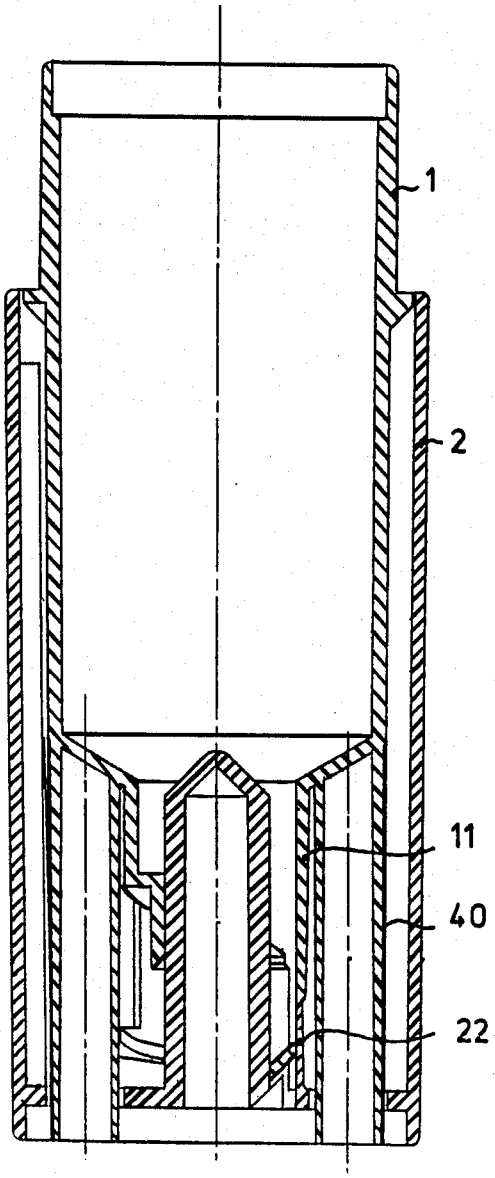
FIG. 16: is a cross-sectional side view of another embodiment of a tablet dispenser.

Yet another embodiment is shown in FIG. 16. In this embodiment, upper portion (1) slides into lower portion (2) which extends to the bottom in the position of use. Except for both portions (1, 2), this embodiment corresponds to the first embodiment described.

The embodiments described above are specifically intended for motor-impaired patients. The tablet dispenser can simply be placed on a table surface, and pressed together by the fist or elbow. The tablet, because of wall (7), cannot roll away. In particular, even rheumatically diseased patients with stunted or stiffened hands can dispense tablets by themselves, without the help of third persons.

The embodiment in accordance with FIG. 16 is, on the other hand, so shaped that unintentionally pressing the dispenser, for example during transport, does not dispense a tablet. To discharge a tablet, the dispenser must be activated in the air, without touching a solid surface. If the dispenser is pressed while standing on a surface, the support feet (40) prevent a relative motion of the upper and lower portions.

I claim:

1. A tablet dispenser with a tablet storage space, at least one tablet separating channel, and one tablet issuing mechanism positioned in a successively descending direction from one another, tablets to be dispensed moving under the influence of gravity, from the starting point in said tablet storage space to said tablet issuing mechanism, said tablet dispenser comprising: at least two portions secured to prevent rotation with respect to one another, said portions fitting into one another in a form-locking manner, capable of being moved relative to one another in the direction of the longitudinal axis; an upper portion located upwardly relative to the direction of discharge, said upper portion forming a funnel-shaped tablet supply space in its interior, a lower tubular extension of said funnel-shaped tablet supply space forming the outer of two concentric ring-shaped walls, a lower portion having an upstanding central column forming the inner of said ring-shaped walls, said two walls being relatively movable with respect to each other, said two ring s-shaped walls defining a tablet orienting space and said tablet separating channel, said tablet orienting space direction and orienting the tablets into said tablet separating channel, said inner concentric wall having a closed top forming a column, said column sliding in and out of said tablet supply space during the relative motion of said upper and lower portions.

2. A tablet dispenser in accordance with claim 1, wherein said lower portion has a plurality of elastically deformable spring elements connected, in one piece, with said lower portion.

3. A tablet dispenser in accordance with claim 1, said tablet orienting space is formed by the bottom of said tablet orienting space sloping downward, said tablet orienting space extending at least partially around the lower area of said column, said tablet orienting space discharging into said vertical tablet separating channel, said vertical tablet separating channel leading to said tablet issuing mechanism.

4. A tablet dispenser in accordance with claim 1, wherein a lower edge of said external wall serves as a support surface of said tablet dispenser, the vertical stroke distance of said upper and lower walls being less than the distance of said intermediate base to said lower edge.

5. A tablet dispenser in accordance with claim 3, wherein said tablet separating channel comprises a plurality of tablet separating channels positioned vertically on said column, said tablet separating channels being formed by walls projecting radially from said column.

6. A tablet dispenser in accordance with claim 1, wherein a disk having a central casing directed upwardly is supported by a plurality of vertical circularly spaced partial walls, the bottom of said partial walls connected to said intermediate base, said central casing penetrating through said intermediate base, said central casing partially encircling said column with the radial separating walls of said separating channel, a relief-type control cam being attached to the external wall of said central casing, said control cam being contacted by at least one contact point solidly connected with said upper portion of said tablet dispenser, said disk gradually rotating during the vertical forcing motion of said upper and lower wall portions, at least one opening in said disk aligning with said separating channels when said upper and lower wall portions are in the completely compressed position.

7. A tablet dispenser with a tablet storage space, at least one tablet separating channel, and one tablet issuing mechanism positioned in a successively descending direction from one another, tablets to be dispensed moving under the influence of gravity, from the starting point in said tablet storage space to said tablet issuing mechanism, said tablet dispenser comprising: at least two portions secured to prevent with respect to one another, said portions fitting into one another in a form-locking manner, capable of being relative to one another in the direction of the longitudinal axis; an upper portion located upwardly relative to the direction of discharge, said upper portion forming a funnel-shaped tablet supply space in its interior, a lower tubular extension of said funnel-shaped tablet supply space forming the outer of two concentric ring-shaped walls, a lower portion having an upstanding central column forming the inner of said ring-shaped walls, said two walls being relatively movable with respect to each other, said two ring-shaped walls defining a tablet orienting space and said tablet separating channel, said tablet orienting space directing and orienting the tablets into said tablet separating channel, said inner concentric wall having a closed top forming a column, said column sliding in and out of said tablet supply space during the relative motion of said upper and lower portions;

said tablet orienting space formed by the bottom of said tablet orienting space sloping downward said tablet orienting space extending at least partially around the lower area of said column, said tablet orienting space discharging into said vertical tablet separating channel, said vertical tablet separating channel leading to said tablet issuing mechanism; and said tablet issuing mechanism comprising a discharge plate having a lower end proceeding on at least one strut and being directed radially inwardly on said tubular extension of said funnel-shaped tablet supply space, in the normal position of said lower and upper portions said discharge plate extending approximately into the plane of said intermediate base, said discharge plate sealing an aperture opening of said separating channel, and an external wall of said separating channel having an upper wall portion being said lower tubular extension, a lower wall portion being said concentric vertical wall, said upper and lower wall portions being flexible, a means for sliding the sides of said upper and lower wall portions against one another when forced together from the top and bottom whereby said force reduces a cross-sectional width of said tablet separating channel, and preventing tablets lying above the tablet to be discharged from sliding downward when said upper and lower wall portions are forced together from the top and bottom.

8. A tablet dispenser with a tablet storage space, at least one tablet separating channel, and one tablet issuing mechanism positioned in a successively descending direction from one another, tablets to be dispensed moving under the influence of gravity, from the starting point in said tablet storage space to said tablet issuing mechanism, said tablet dispenser comprising: at least two portions secured to prevent rotation with respect to one another, said portions fitting into one another in a form-locking manner, capable of being moved relative to one another in the direction of the longitudinal axis; an upper portion located upwardly relative to the direction of discharge, said upper portion forming a funnel-shaped tablet supply space in its interior, a lower tubular extension of said funnel-shaped tablet supply space forming the outer of two concentric ring-shaped walls, a lower portion having an upstanding central column forming the inner of said ring-shaped walls, said two walls being relatively movable with respect to each other, said two ring-shaped walls defining a tablet orienting space and said tablet separating channel, said tablet orienting space directing and orienting the tablets into said tablet separating channel, said inner concentric wall having a closed top forming a column, said column sliding in and out of said tablet supply space during the relative motion of said upper and lower portions; and said tablet separating channel comprising a plurality of tablet separating channels positioned vertically on said column, and said tablet separating channels being formed by walls projecting radially from said column.

9. A tablet dispenser in accordance with claim 8, wherein a disk having a central casing directed upwardly is supported by a plurality of vertical circularly spaced partial walls, the bottom of said partial walls connected to said intermediate base, said central casing penetrating through said intermediate base, said central casing partially encircling said column with the radial separating walls of said separating channel, a relief-type control cam being attached to the external wall of said central casing, said control cam being contacted by at least one contact point solidly connected with said upper portion of said tablet dispenser, said disk gradually rotating during the vertical forcing motion of said upper and lower wall portions, at least one opening in said disk aligning with said separating channels when said upper and lower wall portions are in the completely compressed position.

10. A tablet dispenser with a tablet storage space, at least one tablet separating channel, and one tablet issuing mechanism positioned in a successively descending direction from one another, tablets to be dispensed moving under the influence of gravity, from the starting point in said tablet storage space to said tablet issuing mechanism, said tablet dispenser comprising: at least two portions secured to prevent rotation with respect to one another, said portions fitting into one another in a form-locking manner, capable of being moved relative to one another in the direction of the longitudinal axis; an upper portion located upwardly relative to the direction of discharge, said upper portion forming a funnel-shaped tablet supply space in its interior, a lower tubular extension of said funnel-shaped tablet supply space forming the outer of two concentric ring-shaped walls, a lower portion having an upstanding column forming the inner of said ring-shaped walls, said two walls being relatively movable with respect to each other, said two ring-shaped walls defining a tablet orienting space and said tablet separating channel, said tablet orienting space directing and orienting the tablets into said tablet separating channel, said inner concentric wall having a closed top forming a column, said column sliding in and out of said tablet supply space during the relative motion of said upper and lower portions; and said tablet issuing mechanism comprising a discharge plate having a lower end proceeding on at least one strut and being directed radially inwardly on said tubular extension of said funnel-shaped tablet supply space, in the normal position of said lower and upper portions, said discharge plate extending approximately into the plane of said intermediate base, said discharge plate sealing an aperture opening of said separating channel, and an external wall of said separating channel having an upper wall portion being said lower tubular extension, a lower wall portion being said concentric vertical wall, said upper and lower wall portions being flexible, a means for sliding the sides of said upper and lower wall portions against one another when forced together from the top and bottom whereby said force reduces the cross-sectional width of said tablet separating channel, preventing tablets lying above the tablet to be discharged from sliding downward when said upper and lower wall portions are forced together from the top and bottom.

11. A tablet dispenser with a tablet storage space, at least one tablet separating channel, and one tablet issuing mechanism positioned in a successively descending direction from one another, tablets to be dispensed moving under the influence of gravity, from the starting point in said tablet storage space to said tablet issuing mechanism, said tablet dispenser comprising: at least two portions secured to prevent rotation with respect to one another, said portions fitting into one another in a form-locking manner, capable of being moved relative to one another in the direction of the longitudinal axis; an upper portion located upwardly relative to the direction of discharge, said upper portion forming a funnel-shaped tablet supply space in its interior, a lower tubular extension of said funnel-shaped tablet supply space forming the outer of two concentric ring-shaped walls, a lower portion having an upstanding central column forming the inner of said ring-shaped walls, said two walls being relatively movable with respect to each other, said two ring-shaped walls defining a tablet orienting space and said tablet separating channel, said tablet orienting space directing and orienting the tablets into said tablet separating channel, said inner concentric wall having a closed top forming a column, said column sliding in and out of said tablet supply space during the relative motion of said upper and lower portions; and said tablet orienting space formed by the bottom of said tablet orienting space sloping downward, said tablet orienting space extending at least partially around the lower area of said column, said tablet orienting space discharging into said vertical tablet separating channel, said vertical tablet separating channel having a bottom shoulder sloping downward around said column and leading to said tablet issuing mechanism.

12. A tablet dispenser with a tablet storage space, at least one tablet separating channel, and one tablet issuing mechanism positioned in a successively descending direction from one another, tablets to be dispensed moving under the influence of gravity, from the starting point in said tablet storage space to said tablet issuing mechanism, said tablet dispenser comprising: at least two portions secured to prevent rotation with respect to one another, said portions fitting into one another in a form-locking manner, capable of being moved relative to one another in the direction of the longitudinal axis; an upper portion located upwardly relative to the direction of discharge, said upper portion forming a funnel-shaped tablet supply space in its interior, a lower tubular extension of said funnel-shaped tablet supply space forming the outer of two concentric ring-shaped walls, a lower portion having an upstanding central column forming the inner of said ring-shaped walls, said two walls being relatively movable with respect to each other, said two ring-shaped walls defining a tablet orienting space and said tablet separating channel, said orienting space directing and orienting the tablets into said separating channel, said inner concentric wall having a closed top forming a column, said column sliding in and out of said tablet supply space during the relative motion of said upper and lower portions; and said lower portion having a plurality of elastically deformable spring elements connected in one piece with said lower portion, said lower portion having a cylindrical external wall and a horizontal intermediate base centrally positioned on the internal side of said external wall, and said spring elements positioned on said intermediate base.

13. A tablet dispenser in accordance with claim 12, wherein said spring elements are flat curved springs extending upwardly from said intermediate base around an internal flexible wall.

14. A tablet dispenser in accordance with claim 12, wherein said spring elements vertically extend from said intermediate base abutting on the bottom side of said upper portion forming said funnel-shaped tablet supply space.

15. A tablet dispenser in accordance with claim 12, wherein a lower edge of said external wall serves as a support surface of said tablet dispenser, the vertical stroke distance of said upper and lower walls being less than the distance of said intermediate base to said lower edge.

16. A tablet dispenser in accordance with claim 15, wherein said tablet issuing mechanism comprises a discharge plate having a lower end proceeding on at least one strut and being directed radially inwardly on said tubular extension of said funnel-shaped tablet supply space, in the normal position of said lower and upper portions, said discharge plate extending approximately into the plane of said intermediate base, said discharge plate sealing an aperture opening of said separating channel, and an external wall of said separating channel having an upper wall portion being said lower tubular extension, a lower wall portion being said concentric vertical wall, said upper and lower wall portions being flexible, a means for sliding the sides of said upper and lower wall portions against one another when forced together from the top and bottom whereby said force reduces the cross-sectional width of said tablet separating channel, preventing tablets lying above the tablet to be discharged from sliding downward when said upper and lower wall portions are forced together from the top and bottom.

* * * * *